United States Patent [19]

Okamoto et al.

[11] 4,333,976

[45] Jun. 8, 1982

[54] COMPOSITE WOVEN OR KNITTED FABRIC

[75] Inventors: Miyoshi Okamoto, Takatsuki; Mineto Fushida, Shiga, both of Japan

[73] Assignee: Toray Industries, Incorporated, Tokyo, Japan

[21] Appl. No.: 124,352

[22] Filed: Feb. 25, 1980

Related U.S. Application Data

[63] Continuation of Ser. No. 20,541, Mar. 14, 1979, abandoned.

[30] Foreign Application Priority Data

Mar. 15, 1978 [JP] Japan ..... 53-28639

[51] Int. Cl.[3] ..... B32B 33/00

[52] U.S. Cl. ..... 428/91; 428/25; 428/233; 428/236; 428/245; 428/253; 428/266; 428/446

[58] Field of Search ..... 428/85, 90, 91, 92, 428/93, 95, 96, 97, 245, 233, 236, 253, 266, 446

[56] References Cited

U.S. PATENT DOCUMENTS

| | | | |
|---|---|---|---|
| 3,865,678 | 2/1975 | Okamoto et al. | 428/91 |
| 4,103,054 | 7/1978 | Okamoto et al. | 428/91 |
| 4,109,038 | 8/1978 | Hayashi et al. | 428/91 |
| 4,146,663 | 3/1979 | Ikeda et al. | 428/253 |

FOREIGN PATENT DOCUMENTS

| | | |
|---|---|---|
| 45-711 | 1/1970 | Japan . |
| 46-37198 | 11/1971 | Japan . |

*Primary Examiner*—James J. Bell
*Attorney, Agent, or Firm*—Miller & Prestia

[57] ABSTRACT

Woven or knitted fabrics of soft touch and elegant appearance composed of yarns including bundles of superfine fibers of less than 0.7 denier which are at least partly bound with a cured silicone polymer.

11 Claims, 7 Drawing Figures

COMPOSITE WOVEN OR KNITTED FABRIC

This is a continuation of application Ser. No. 20,541, filed Mar. 14, 1979, now abandoned.

DETAILED DESCRIPTION OF THE INVENTION

This invention relates to composite woven or knitted fabrics of high quality, more particularly to a novel fibrous material to be used for the said fabrics, which fibrous material is of high quality appearance and has fine elegant and supple naps, which are flexible and soft to the touch, whose naps tend to stay erect to a certain extent so as not to lie down readily in use, and which possess a desirable degree of slipperiness and yet have good smoothness as well as luster, and which has a relatively pronounced resistance to melting, even when exposed to a smouldering cigarette.

While raised fabrics made out of natural animal hairs have many excellent distinctive features, they also present a number of drawbacks. These drawbacks include, for instance, the fact that it is necessary to obtain the hairs from live animals, which might be considered as cruelty to them, and which also limits the available output. Further disadvantages include difficulty in processing, likelihood of damage by noxious insects such as moths, etc., heavy weight, susceptibility to losing shape or felting as a result of washing, proneness to deterioration, weakness, etc.

An important object of this invention is to create a novel material which is free from such drawbacks as mentioned above, and which can be used to make woven or knitted fabrics of a high quality animal hair type fabric tone. Other objects include providing a novel material which:

1. can be manufactured by man;
2. has naps that are not readily laid down and are of massive bulk;
3. has naps that are not only flexible but also rich in waxiness and have fine or good touch;
4. are not readily perforated upon contact with lighted cigarettes or the like;
5. are capable of having superfine nap ends, thus having a fine texture for purposes of appearance and touch; and
6. are susceptible of bright coloration.

In accordance with this invention, the foregoing and other objects are attained by providing material for making woven or knitted fabrics that are provided with naps composed of bundles of superfine fibers of less than 0.7 denier, bound together with a cured silicone polymer.

IN THE DRAWINGS

FIGS. 1(*a*) and (*b*) represent respectively perspective and sectional views of a multicomponent islands-in-a-sea type fiber (integral fiber) as an example for use in this invention.

FIG. 2 is a sectional view of the fiber of FIG. 1(*b*) with the number of islands increased to 36.

FIGS. 3(*a*)–3(*f*) are schematic drawings which show the texture of composite woven or knitted fabrics being transformed in the course of processing according to this invention.

Figure 1:
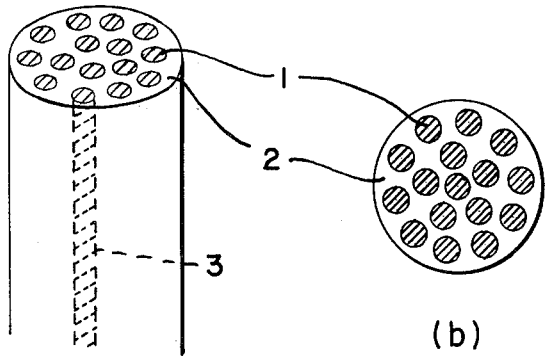

Although the invention is described in detail hereinafter with respect to specific embodiments selected for illustration in the drawings, this description is not intended to limit the scope of this invention, which is defined in the claims.

A variety of superfine fibers may be utilized for the bundles to be used in this invention. They comprise, for instance, the commonly called islands-in-a-sea type fibers, improved blended spun fibers in which one of the components is arranged to stand in long and fine rows amidst the others, multicomponent fibers composed of a combination of polymers lacking in affinity for each other and capable of being split mechanically, fibers made by binding together superdrawn yarns or superfine wet spun yarns or superfine yarns melt spun under strictly selected conditions, etc. by means of a binding agent, for example. With a view to giving full flexibility to the fibers composing the bundles, it is preferable to make use of fibers which are finer than 0.7 denier, in particular those of 0.6–0.0001 denier, those finer than 0.0001 denier being difficult to manufacture.

Figure 2:
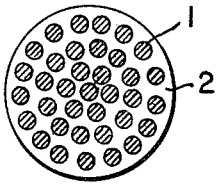

Islands-in-a-sea type fibers as shown in FIGS. 1(*a*) and (*b*) are available as suitable examples of such fibers, the former being a perspective projection and the latter a sectional view of the said fiber. FIG. 2 is a sectional view of the fiber, in which the islands are increased to 36 in number. The islands-in-a-sea type fiber has a number of advantages including ease of manufacture, good yield, high dispersibility, stability in quality, aptness for reconstitution, ease of structure control and ease of twining, for example.

The cross section of the island may be circular, triangular or of a variety of other shapes. As the island component, a polyester such as polyethylene terephthalate, polybutylene terephthalate or their copolymers, a polyamide such as nylon 6, 66, 6–10, etc., polypropylene or polyethylene, etc. may be used.

In some cases, fabrics are woven or knitted from the beginning in such a manner as to provide them with naps. Velvet, velvet knit, plush knit, pile fabric, velveteen, corduroy or flocked woven or knitted fabrics can be obtained, for example. Fabrics resulting from other cases in which naps are not inherently provided by the knitting or weaving operations are those on which naps are to be formed at an appropriate later time by means of a raising process. However, in view of the ease of performing the raising operation, it is preferable to weave or knit fabrics in such a texture and in such a manner that many fibers which may be rendered superfine (or the superfine fibers themselves) remain risen above or exposed upon the fabric surface. Various kinds of satins, such as 5-leaf satin, turkey satin or tricot satin and the like are excellent examples.

Any fabric portions other than naps (such as base portions, for example) need not be composed specifically of superfine fibers. Whereas an entire fabric composed in the main of superfine fibers can produce a flexible sheet, a tense and firm sheet can be obtained by using thick fibers of more than 0.7 denier in the base portion of the fabric.

Preferably, a shape-fixing agent is deposited in advance on the woven or knitted fabric. Such agents, soluble in water or hot water, include polyvinyl alcohol, partly saponified polyvinyl alcohol, carboxymethylcellulose, methylcellulose, sodium polyacrylate, polyacrylamide, starch, etc. Next, a solvent is used which has the power to dissolve the sea component of the islands-in-a-sea type fiber. For example, this may be a single solvent or a combination of more than two solvents chosen from the group consisting of trichloroethylene, perchloroethylene, toluene, xylene, etc. when the sea component consists of polystyrene or its copolymer. The solvent is used as an agent for removing the sea component from the islands-in-a-sea fiber.

The superfine fiber woven or knitted fabric thus obtained is treated by the addition of an organic silicone compound which is capable of being cured. A curing agent is resorted to in most cases but curing may be accomplished by simple exposure to water molecules in the air in some cases. Two types of curing, curing under heating and curing at room temperature, are utilizable.

Any known organic silicone compounds may be utilized, provided that they are subject to curing. Typical organic silicones are described in patents held by Dow-Corning (Japanese Official Publications of Patent Applications Nos. 94295/75, 27704/76, 27705/76 and 27706/76), all of which disclose suitable organic silicone compounds which are useful in the practice of this invention. In addition, various technical documentation materials have been issued by Toray Silicone, Toshiba Silicone, Sinetsu Chemical Industries, etc., on the subject.

The main chain of the organic silicone compound is formed of a polysiloxane, polydimethylsiloxane being the most typical among others. Also well known, and suitable for use in the practice of this invention, are silicon-containing chains in which a minor part or a fairly sizable part is replaced with a phenyl radical, a hydrogen atom or a vinyl radical available for a bridging reaction. The molecular chains terminate in general in such groups as —OH, —CH=$CH_2$, —OR, etc., which can react per se or with different silanes. In the reaction, water molecules, platinum compounds like chloro-platinic acid, organic metal compounds like peroxides or fatty acid salts, liberated radical compounds, aminosilane compounds, etc. may be concurrently used according to the nature of the reaction.

The molecular weight of the chain is about 10,000–600,000, for example, in case of the chains most utilized.

It may be possible to add to the silicone compounds various compounds which are usually used to improve the physical properties of cured materials. These include silicone oxide, such as silica aerosol as a typical example, or titanium oxide, carbon black, calcium carbonate, kieselguhr, quartz powder, asbestos, zinc oxide, zirconium silicate, etc.

These are preferably to be treated with a chain-formed or ring-formed silane, silanol, siloxane or silazane. Besides, pigments for coloration, extracting agents for creating porosity and various other additives may be used.

In accordance with this invention an organic silicone compound is deposited on woven or knitted fabrics composed of superfine fibers by impregnation or coating accompanied by permeation. Although the silicone compound may also be directly deposited (impregnation or coating) without being diluted with a solvent or emulsified, it is more advantageous from the viewpoints of operation efficiency and stability in quality to use a solution or an emulsion (dispersion). The solvent or the dispersion medium is removed later, for example by drying.

The product is then cured by passing the sheet through a heating zone or by leaving it to stand for a sufficient time in air at about room temperature. The curing process does not necessarily end at this stage, but may be continued through later processing steps. The curing process may continue for a very long time, even after finishing of the sheet in some cases. Heat curing is preferable to curing at room temperature from the viewpoints of operation efficiency and stability. However, there are also many cases whereby it is more suitable from the standpoint of the quality of the finished product to cure the sheet without heating, preferably after drying of the solvent by heating, and to allow it to stand for a long time at a nearly constant temperature i.e. at room temperature, thus curing it by the action of the water molecules contained in the air.

The organic silicone compound, having been thus cured, is solidified around the fine fibers and adhered to the bundles of fibers. Thereafter, the shape-fixing agent previously deposited is eliminated.

An example of a desirable combination for such a process is the case in which the fibers are composed of a polyester or nylon, partly saponified polyvinyl alcohol is used as the shape-fixing agent and silicone rubber is used as the cured silicone polymer.

In case of woven or knitted fabrics on which naps have not been formed beforehand, the raising treatment is carried out at an appropriate time in the course of the aforementioned processing, the time not being particularly critical.

Various types of raising machines, known per se, may be used for raising the nap of superfine fibers. A card cloth type (needle fillets type) raising machine or a buffing machine may be used, for example.

In the case of the use of fine fibers from multicomponent fibers composed of combinations of non-affinitive polymers in which one component can be mechanically separated from the other, the raising treatment may be conducted concurrently with a superfining treatment, so that both steps may be conducted at one time.

When napped gray fabrics are not dope-dyed (not colored with pigments) they are usually dyed in the next stage. In this stage dyeing (not dope-dyeing), it is of importance that the remaining cured silicone polymer which serves as a binder and the like should be removed only to a small extent, since the presence of the silicone polymer is essential to the objects of this invention. Silicone rubbers cured by standing at room temperature for a long time which can satisfactorily endure the subsequent dyeing treatment are preferred from this point of view. Moreover, reduction washing is desirable after dyeing in case of the presence of a cured silicone polymer, because the reduction washing step brings about a considerable improvement in color fastness.

Known appropriate finishing agents may be used after dyeing.

The conditions of the textures of composite woven or knitted fabrics being transformed in the course of the process according to this invention are more particularly described with reference to FIGS. 3(*a*)-(*f*) which schematically illustrate one example.

Figure 3:
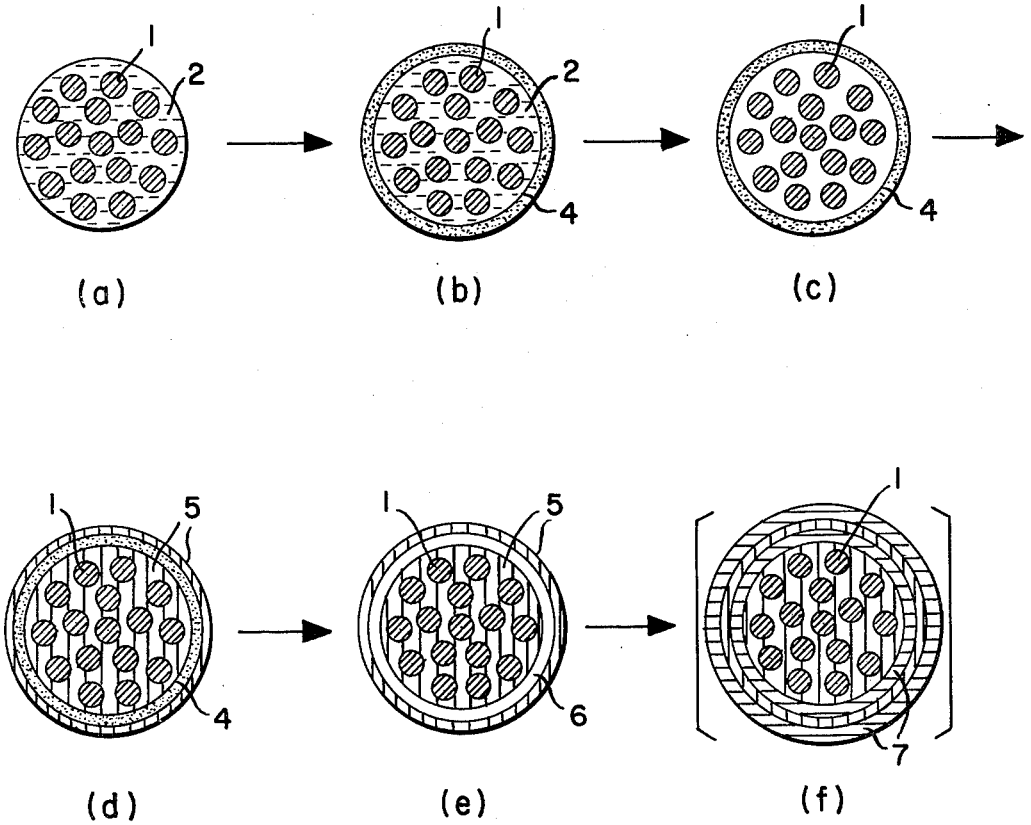

FIG. 3(*a*) represents a view in cross section of a multicomponent islands-in-a-sea type fiber which composes a part of the woven or knitted fabrics showing the island components 1 and the sea component 2. After the woven or knitted fabric has been formed, the sea component 2 has not yet been removed.

FIG. 3(*b*) shows the same fiber after a shape-fixing agent 4 (which is also a composite component as described later) has been deposited, forming a three-component fabric.

FIG. 3(*c*) shows the sectional appearance of the modified fiber after the sea component 2 of FIG. 1 has been removed, liberating the superfine fibers comprising the island components 1 which are covered by the shape-fixing agent 4. This intermediate product may be taken as a hollow multicomponent fiber having numerous cores.

FIG. 3(*d*) illustrates the condition of a fiber 1 after impregnation with an organic silicone compound 5. The organic silicone compound is deposited in a manner to reach the superfine fibers inside the hollows. Since the spaces among the exterior portions of the multicomponent fibers are already occupied to a certain extent by the shape-fixing agent 4, and since the sea component 2 has been removed from the spaces between the islands 1, the organic silicone compound is deposited not only on the outer surface of shape-fixing agent 4, but also in the hollowed spaces between individual island components 1, so that the superfine fibers constituting the island components become relatively firmly bound by the silicone compound in the form of bundles.

The quantity of organic silicone compound that may be adhered to the outer surfaces of the shape-fixing agent may be varied considerably.

FIG. 3(*e*) shows the structure after the shape-fixing agent 4 of FIG. 3(*d*) has been removed; since a space 6 has been formed around the bundles of bound superfine fibers 1 the sheet is rendered flexible.

FIG. 3(*f*) illustrates the product after an elastic polymer has been deposited, when desired or necessary, as described later. The elastic polymer may be used for preventing the naps from falling off or for contributing firmness or tenseness to the knitted or woven fabric made from the fiber.

The naps obtained in accordance with this invention are composed of bundles of superfine fibers bound together with a cured silicone polymer. These naps are characterized by being rich in waxiness, by having a tendency to remain somewhat erect on account of being bound together, by having flexibility because of the presence of superfine fibers, by being bound with a proper force effective between the superfine fibers and the cured silicone polymer, by having resistance to melting when contacted with a lighted cigarette, and by being susceptible of bright coloration by dyeing. In short, the naps are of such waxiness, massiveness and bulk as to present a high quality feel and touch, an elegant appearance and beautiful coloration.

Figure 4:
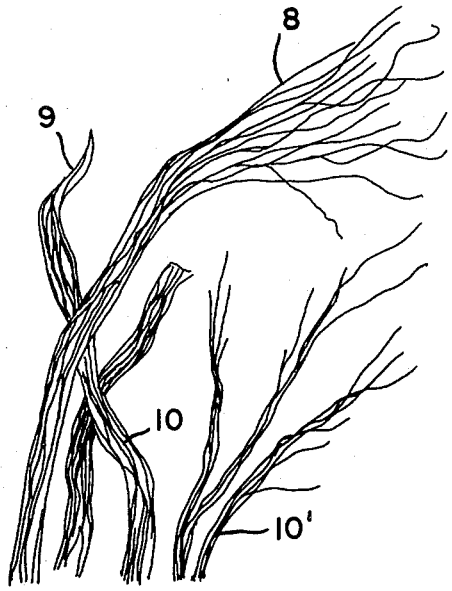
FIG. 4 represents an enlarged example of naps of the composite woven or knitted fabrics to which this invention is applied.

On the other hand, the knitted or woven fabrics of this invention are usually raised and dyed, if necessary. In this special case the cured silicone polymer tends to be scraped off the nap ends, so that the binding of the ends of the naps by the cured silicone polymer becomes loosened as shown in FIG. 4, for example. These naps differ greatly from any comparable suede fnish materials known to be available. In this example, the naps are bound in bundles by the cured silicone polymer or by a substance containing a large amount of such cured silicone polymer. As seen in FIG. 4, some of the naps show a tendency toward being tapered owing to a decrease in the number of superfine fibers as a result of a special raising treatment such as additional buffing, for example. In FIG. 4, the number 8 represents the separated ends of the superfine fibers, the number 9 represents the naps which still remain bound, in which the number of remaining superfine fibers has been decreased, and the number 10 and 10' designates the superfine fibers which remain bound or partially bound by the silicone resin.

Figure 5:
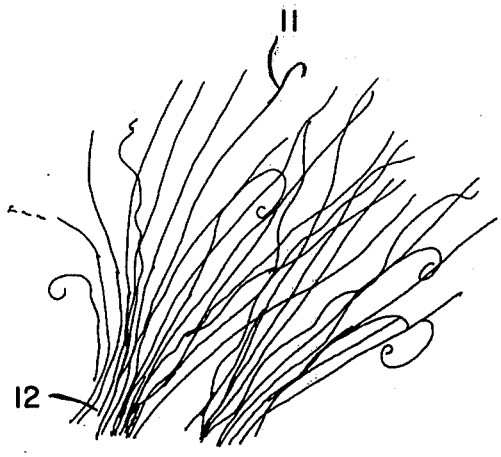
FIG. 5 represents an enlarged view of naps of ordinary suede.

FIG. 5 shows, on the other hand, a case similar to conventional suede wherein polyurethane is used instead of an organic silicone compound. This is illustrated for comparison purposes, and for reference. In this case, a suede tone being created, the condition of the naps is as shown in FIG. 5, for instance, but the naps which usually pack down in a more or less flat configuration have been shown in a more erect position for ease of understanding. The portions near the nap ends 11 and the portions near the bottoms 12 are fine and they do not include combined separated and bound portions such as the portions 8 and 10 of FIG. 4.

Figure 6:
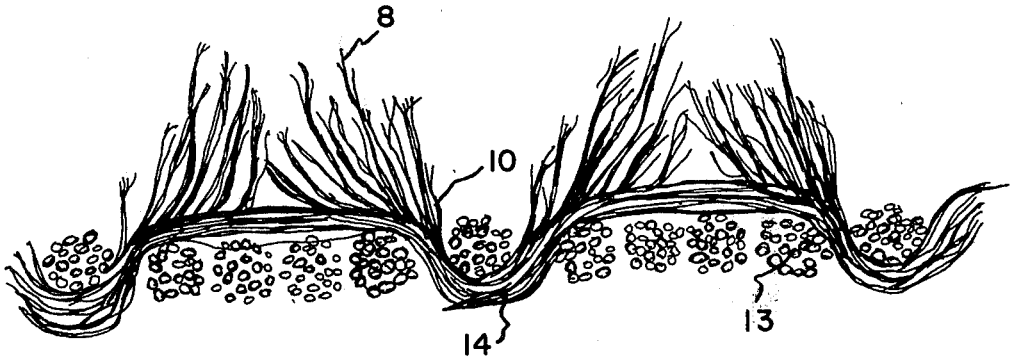
FIGS. 6 and 7 represent a fragmentary sectional view of fabrics which includes naps of this invention.
Figure 7:
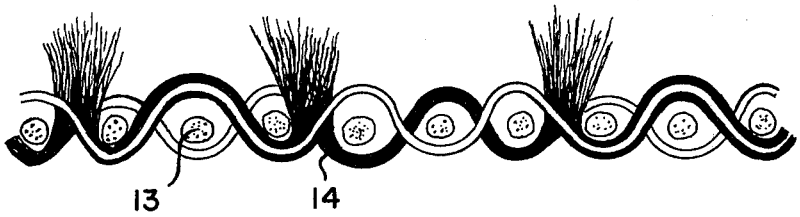

FIGS. 6 and 7 show schematically woven fabrics having ordinary warp yarns 13 and special weft yarns 14 of this invention, which have raised naps 10 and separated ends of superfine fibers 8 of the type illustrated in FIG. 4 of the drawings.

In this way, on a woven or knitted fabric 13, 14 according to this invention, the naps are bound and thick at least around the portions 10 (FIG. 4) closest to the body of the fabric. Still, upon an additional raising treatment like buffing, the nap ends tend to become tapered or fine after having been scraped off or ramified, and in any case the naps develop fine ends having good feel or touch. The naps tend to remain firm, because many superfine filaments are bound together by a cured silicone material to form a "leg" 10 connected to the body of the fabric. For this reason, in comparison with the naps whose bottom portions or portions adjacent to the fabric are not bound, namely those of suede tones so far available, the naps according to this invention have a minimum tendency to be laid down in a reversible manner. In other words, they rarely present a suede effect. It is thought that this is one of the factors providing a unique hand or feel to the fabrics obtained according to this invention.

It is often desirable to treat an entire fabric with various fiber treating agents such as silicone or paraffin which are capable of improving slipperiness, after termination of the treatment with the cured silicone polymer. This tends to improve the hand or feel of finished fabrics, or to facilitate buffing or both.

In accordance with this invention it is also desirable to treat the finished fabric after dyeing with, for instance, an acryl emulsion of the curable type, or with a solution which forms silicone rubber (resin) or its emulsion, with a view to preventing the naps from falling off in sure or in subsequent processing.

The amount of cured silicone polymer to be deposited on the woven or knitted fabrics should be 0.3–50 preferably about 3–30 parts by weight per 100 parts by weight of the composite fabric. When an elastic polymer is additionally concurrently used on the finished fabric, the elastic polymer should be deposited in an amount of 0.3–50, advantageously 0.5–20 parts by weight per 100 parts by weight of the composite fabric (total weight of the woven or knitted fabric plus the silicone polymer plus the elastic polymer).

The fabrics obtained according to this invention are useful for making garments such as coats, suits, blazers, shawls, mufflers, skirts, trousers pants, shirts, waistcoats, hats, etc., and for furniture, various types of sheets, bed covers, wall hangings, wall surface ornaments, jewel cases, etc.

The following Examples are illustrative of this invention. They are, however, by no means limitative of the scope of this invention, which is defined in the appended claims.

EXAMPLE 1

A woven fabric was made of warp yarns and of two filling yarns. Multifilament polyethylene terephthalate yarns. 50 denier and 24 filaments, were used as the warps. The first wefts were woven in 5 leaf satin face against the warps, and were islands-in-a-sea type fibers (integral fibers) (the island component being polyethylene terephthalate, the sea component being polystyrene). The islands-to-sea ratio was 90/10 and the number of islands was 16). The weft yarns were 245 denier and 40 filaments. Polyethylene terephthalate false twist yarns (50 denier, 24 filaments) were used as the second wefts in a twill back weave, 2 up and 3 down against the warps, so that a back filling fabric (weft backed weave) was obtained. The density of yarns at this time was 166 yarns/in for the warps, 78 yarns/in for the first wefts and 78 yarns/in for the second wefts.

After a finishing agent for raising had been added to this fabric, the face was passed 18 times through a card cloth raising machine (with needle fillets), and a raised fabric with nap fibers composed of island-in-a-sea type fibers (integral fibers) used as the first wefts was obtained.

An 18% aqueous solution of water soluble polyvinyl alcohol was deposited on this raised fabric and dried by heated air. Next, the fabric was well washed with trichloroethylene to remove the sea component from the first wefts, and was dried.

A solution was made up by preliminarily dissolving, in 967 parts by weight of trichloroethylene, 30 parts by weight of a composition containing:

(a) 95 parts by weight of polydimethylsiloxane having —OH end groups and having a molecular weight of 50,000 (25° C., 4000 cs), and (b) 5 parts by weight of partly condensed methyltrimethoxysilane. Then the fabric was impregnated with about 200% by weight of a silicone treating solution prepared by adding under agitation 3 parts by weight of $(CH_3O)_3Si(CH_2)_3NHCH_2CH_2NH_2$ to the solution previously prepared. Trichloroethylene was removed at about 60° C., and the silicone was cured by allowing to stand for 72 hours in air at a room temperature of 25° C. and under a relative humidity of 60%. The amount of silicone deposited was 6.5% in the solid state, based upon the weight of the fabric to be treated.

Finally, the treated fabric was dyed light brown with a disperse dye by means of a high pressure type dyeing machine for high temperature use and was treated with a finishing agent and brushed to obtain a finished fabric.

The finished fabric thus obtained was a raised fabric having a soft touch, proper waxiness, brightness in color and a high quality feeling.

EXAMPLE 2

A fabric was prepared of base warp yarns of polyethylene terephthalate, 50 D-10/2 (total: 100 D and 250 twists/meter).

Islands-in-a-sea type fibers were used as the warps of the naps, the island component being polyethylene terephthalate and the sea component being polystyrene, the islands-to-sea ratio being 96/4 and the number of islands being 16. These were 50 D-18 f and 600 twists/meter.

The wefts of the base were yarns of 50 D, 18 filaments.

These warps and weft were woven into a velvet texture. The density of the yarns at this time was 67 yarns/in for the warps (in the base as well as in the naps) and 92 yarns/in for the wefts (cut by about 1.25 mm with a view to producing naps simultaneously with weaving).

A 12% aqueous solution of polyvinyl alcohol soluble in water at normal temperature was added to the fabric. After drying, the fabric was well washed with trichloroethylene to remove the sea component used as the warps and was dried again. A solution was made by preliminarily dissolving, in 967 parts of trichloroethylene, 30 parts by weight of a composition containing the following:

(a) 95 parts by weight of polydimethylsiloxane having —OH end groups and a molecular weight of 50,000 (25° C., 400 cs), and (b) 5 parts by weight of partly condensed methyltrimethoxysilane.

The fabric was impregnated with about 200% by weight of silicone treating solution prepared by adding under agitation 3 parts by weight of $(CH_3O)_3Si(CH_2)_3NHCH_2CH_2NH_2$ to the said solution previously prepared. Trichloroethylene having been removed at about 60° C., the silicone was cured by exposing it for 72 hours in air at a temperature of 25° C. and under a relative humidity of 60%. The amount of solid state silicone deposited on the fabric to be treated was 7.1%. Polyvinyl alcohol was removed thereafter with hot water, and the treated fabric was dried.

Finally, the treated fabric was dyed light brown with a disperse dye by means of a high pressure type dyeing machine for high temperature operation, and was brushed to obtain a finished fabric.

It will be appreciated that equivalent materials and compounds may be substituted for those specifically referred to herein, without departing from the spirit and scope of this invention as defined in the appended claims.

We claim:

1. Woven or knitted fabric containing a plurality of naps composed of bundles of superfine fibers of less than 0.7 denier which are bound with a cured organic silicone polymer.

2. Woven or knitted fabric according to claim 1, characterized by the presence of fine nap ends.

3. Woven or knitted fabric according to claim 1 or 2, in which the superfine fibers have a thickness of 0.6–0.001 denier.

4. Woven or knitted fabric according to claim 1 or 2, in which the organic silicone polymer has a molecular weight of about 10,000–600,000.

5. Woven or knitted fabric according to claim 1 or 2, in which the amount of deposited organic silicone polymer is about 3–30 parts by weight per 100 parts by weight of the total fabric plus silicone polymer.

6. Woven or knitted fabric according to claim 1 or 2, in which the fabric is satin or velvet.

7. A fibrous bundle for use in textile material comprising a multiplicity of elongated synthetic polymeric superfine fibers of less than 0.7 denier, said bundle having a leg portion in which said superfine fibers are arranged closely adjacent one another in substantially parallel relationship, a plurality of the fibers in said leg portion being bound together with a cured organic silicone polymer, and said bundle having a free end portion integral with said leg portion in which at least some of the fibers of said plurality of fibers are free of any bonding to one another.

8. In a method of making a fibrous bundle for use in textile material from a fiber composed of a multiplicity of islands-in-a-sea superfine fibers of less than 0.7 denier, the steps which comprise encapsulating the fiber, dissolving out the sea component to produce encapsulated substantially free superfine fibers, binding said superfine fibers with a cured silicone polymer, and removing the encapsulation.

9. The method defined in claim 8 further including the step of removing cured silicone polymer from an end portion of said fibrous bundle while leaving said cured silicone polymer in another portion thereof.

10. The method defined in claim 8 further including the step of forming said fiber into a fabric prior to said encapsulation step.

11. The method defined in claim 10 further including the step of raising nap on said fiber subsequent to said fiber formation step.

* * * * *